US007762555B1

(12) United States Patent
Hofferber et al.

(10) Patent No.: US 7,762,555 B1
(45) Date of Patent: Jul. 27, 2010

(54) DEVICE FOR HOLDING AND VIEWING PLAYING CARDS

(76) Inventors: David A. Hofferber, 101 Cherokee Rd., Lexington, NE (US) 68850; Christopher P. Farrell, 101 Cherokee Rd., Lexington, NE (US) 68850

( * ) Notice: Subject to any disclaimer, the term of this patent is extended or adjusted under 35 U.S.C. 154(b) by 23 days.

(21) Appl. No.: 12/231,615

(22) Filed: Sep. 4, 2008

Related U.S. Application Data

(63) Continuation-in-part of application No. 11/414,944, filed on May 1, 2006, now Pat. No. 7,478,813.

(51) Int. Cl.
*A63F 1/10* (2006.01)

(52) U.S. Cl. ..... 273/150; 273/148 A; 273/148 R; 273/309

(58) Field of Classification Search ..... 273/150, 273/148 A, 148 R, 309
See application file for complete search history.

(56) References Cited

U.S. PATENT DOCUMENTS

| | | | | |
|---|---|---|---|---|
| 4,555,084 | A * | 11/1985 | Anderson et al. | 248/460 |
| D286,897 | S | 11/1986 | Herbert | |
| D347,451 | S | 5/1994 | Kazakowitz | |
| 5,445,378 | A | 8/1995 | Cook | |
| 5,472,198 | A | 12/1995 | Alvarez | |
| D367,082 | S | 2/1996 | Harley | |
| 5,590,880 | A | 1/1997 | Flam | |
| D431,052 | S | 9/2000 | Wilcox | |
| 6,349,940 | B1 | 2/2002 | Nimry | |
| D493,199 | S | 7/2004 | Cowgill | |
| 2006/0163808 | A1 * | 7/2006 | Belill | 273/150 |

* cited by examiner

*Primary Examiner*—Benjamin H Layno
(74) *Attorney, Agent, or Firm*—Montgomery Patent and Design; Robert C. Montgomery; Joseph T. Yaksich

(57) ABSTRACT

A device for holding and viewing playing cards is herein provided and discloses an apparatus that allows the viewing of playing cards that are placed down on the device for players who have limited use of their hands or would benefit from such a device. The device takes the form of an angled stand, preferably comprising approximate dimensions of four (4) inches by six (6) inches where a portion of this area is used to hold the cards face down, as placed there by a dealer or a player's assistant. The device is shielded so that adjacent players are denied the ability to view the cards. A dual mirror assembly is visible through a viewing window that is used by the player. In such a manner, players with limited or no use of their hands or arms can see their cards in an easy manner without the aid of another person. Alternate embodiments for the present device comprise different sizes to facilitate any number of playing cards required by desired card games.

5 Claims, 11 Drawing Sheets

DEVICE FOR HOLDING AND VIEWING PLAYING CARDS

RELATED APPLICATIONS

This application is a continuation-in-part and claims the benefit of U.S. patent application Ser. No. 11/414,944, filed May 1, 2006 now U.S. Pat. No. 7,478,816, the entire disclosures of which are incorporated herein by reference.

FIELD OF THE INVENTION

An apparatus is provided that allows a person to view playing cards that are placed face-down on the device, without anyone else being able to see them, comprises a stand wherein the playing cards are placed on a top portion, thereby projecting an image onto an interior mirror assembly such that the player can view the playing cards through a viewing window at the end of the device.

BACKGROUND OF THE INVENTION

Card games are among the most popular of today's recreational and social activities. Millions of people enjoy the numerous existing card game variations. These games are popular among people of all ages, as they provide a means to gather with friends and socialize. A common factor in just about every type of card game is that a player must hold their cards, most typically in close proximity to one's body, to prevent other players from seeing them. While this is usually a simple and obvious task, it is almost impossible for those with limited use of their hands and/or arms. In cases where a disabled player wishes to play cards, someone else must hold the disabled person's cards and go to great lengths to avoid looking at them, especially if they are also playing. Whatever the reason for not being able to hold one's own cards, it affects their ability to play the card games, making it less enjoyable for all involved. The development of the present invention addresses this issue. While the present invention is most particularly suited for the popular Texas Hold-Em version of poker, it can easily be used for other playing card games.

Several attempts have been made in the past to provide a means to assist disabled persons in holding and viewing playing cards in a secure and sturdy apparatus. U.S. Pat. No. 6,349,940 in the name of Nimry discloses a collapsible game card holding means consisting of a plurality of flexible fingers that are separated and retracted in a fan-like configuration. The Nimry device does not disclose a novel box-like mirror apparatus to provide security from other players' viewing angles.

U.S. Pat. No. 5,590,880 issued in the name of Flam provides a card holder in the form of a shell or shield with slots or pockets into which a plurality of cards are placed. In the Flam device, the card holder is configured in a vertical device, which provides less stability when placed on a horizontal surface. Hence, the Flam device must be held and is therefore not in the scope of the present invention.

U.S. Pat. No. 5,472,198 issued in the name of Alvarez describes a playing card holder with a hand shape with rubber finger tips that is attached to a plate with a spring-biased clip to retain the cards and finger rings on the plate that the player uses to hold the device. The Alvarez device suffers from the same problems as the aforementioned Flam device in that it is designed to be held by the player and, therefore, also does not fall under the scope of the present invention.

U.S. Pat. No. 5,445,378 issued in the name of Cook discloses a playing card holder having an extendable handle attached to a head extension, which is in turn attached to a support plate with a plurality of pockets for retaining playing cards therein. The Cook device is also equipped with a base for supporting the device on a horizontal surface. The Cook device lacks features to eliminate surreptitious viewing from neighboring players and also must be manipulated by hand, which is not necessary with the present invention.

Other, various ornamental designs of playing card holders are prevalent in the prior art, such as U.S. Pat. No. D 493,199, issued in the name of Cowgill; U.S. Pat. No. D 431,052, issued in the name of Wilcox; U.S. Pat. No. D 347,451, issued in the name of Kazakowitz; U.S. Pat. No. D 286,897, issued in the name of Herbert; and U.S. Pat. No. D 367,082 issued in the name of Harley.

None of the prior art particularly describes an apparatus and method for displaying and viewing playing cards in a novel, box-like mirrored assembly that can be placed on a horizontal surface and provides a secure means for viewing said playing cards. Accordingly, there is a need for an apparatus suitable for use by disabled, elderly, novice, or expert players to confidently view playing cards in a secure manner that is also sturdy, resilient, and easy to use.

SUMMARY OF THE INVENTION

In view of the foregoing disadvantages inherent in the prior art, it has been observed that there is a need for a device that secures and displays playing cards.

It has further been observed that there is a need for a device to display playing cards in a secure manner as to eliminate the surreptitious viewing of one's playing cards by a neighboring player.

The object of the invention is to provide such a device to enable a user to secure and display their playing cards only to him or herself.

It is a further object of the invention to secure and display a user's playing cards such that neighboring players cannot see said playing cards, no matter what the viewing angle may be.

It is still a further object of the invention to provide users with a novel mirror system in a box-like structure for the viewing of said playing cards.

It is yet another object of the present invention to provide a device that can be easily placed on a horizontal surface.

Still yet another object of the present invention is to provide means to vertically adjust the viewing angle of the mirror system depending on the position of the user.

The device for holding and viewing playing cards possesses a small window to reduce the odds of viewing by a competing player.

The device for holding and viewing playing cards, in an alternate embodiment, possesses an alternate mirror embodiment comprising a pair of second side walls, a second bottom wall, a second rear wall, a second top wall, a second upper interior wall, a second playing card surface, a first rear wall, a second interior mirror, a second bottom mirror and a second viewing window.

The device for holding and viewing playing cards, in an alternate embodiment, is manufactured of similar materials as the preferred embodiment.

The device for holding and viewing playing cards, in an alternate embodiment accommodates two (2) playing cards.

The device for holding and viewing playing cards possesses two second side walls, trapezoidal in shape and defined by a dimension of approximately four (4) inches that provides an interior space within.

The device for holding and viewing playing cards possesses a second rear wall of rectangular shape that extends upwards from the bottom rear corners of the second side walls and having a length approximately a third of that of the second side walls.

The device for holding and viewing playing cards possesses a second rear wall rectangular in shape that extends from the bottom rear corners of the second side walls, along a vertical front edge to the top rear corners of the second side walls.

The device for holding and viewing playing cards possesses a second top wall which extends rearward from the upper corners of the second side walls and terminates approximately three-quarters (¾) of an inch from the second rear wall.

The device for holding and viewing playing cards possesses a second top wall that has numeric indicia comprised thereon to represent the loading positions for two (2) playing cards.

The device for holding and viewing playing cards possesses a second playing card surface that is transparent and is attached along the top edge of the second rear wall and projects perpendicular to the second rear wall.

The device for holding and viewing playing cards possesses a second upper interior wall transparent and rectangular in nature, attached to the front edge of the second playing card surface and extending vertically to a connection point along the bottom surface of the second top wall.

The device for holding and viewing playing cards possesses a first rear wall with a second viewing window approximately one (1) inch high by two (2) inches wide located at the top left corner of first rear wall.

The device for holding and viewing playing cards possesses a second viewing window that permits the unhindered viewing of the reflected image of the playing cards from the reflection of the image onto a second bottom mirror and second interior mirror.

The device for holding and viewing playing cards possesses a second interior mirror that is shaped to fit the width of the interior space as defined by the two (2) second side walls.

The device for holding and viewing playing cards possesses a second interior mirror that is oriented at approximately sixty degrees (60°) from the horizontal plane.

The device for holding and viewing playing cards possesses a second rectangular bottom mirror affixed to the bottom edge of the second interior mirror and projecting in a perpendicular fashion toward the front of the device.

The device for holding and viewing playing cards possesses two mirrors that may positioned in any manner within the device to afford an easy and discreet viewing by the player of the cards contained within the holder.

To achieve the above and other objectives, the present invention provides a method for displaying and viewing playing cards comprising steps of, providing a novel mirror system in a box-like structure for holding and displaying playing cards; placing said structure onto a horizontal surface in front of the player; placing playing cards face down on a top tray of the structure, such that a top portion of each placed playing card extends over the top tray; reflecting the image of the extended top portion of each placed playing card from an angled bottom mirror onto an interior mirror and through the viewing window to the player; and, adjusting the viewing angle of the reflected image of the placed playing cards by vertically adjusting opposing legs, wherein said leg adjustment manipulates the structure with respect to the horizontal surface.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | |
|---|---|
| 10 | device for holding and viewing playing cards |
| 11 | first side wall |
| 12 | first top wall |
| 13 | wing nut |
| 14 | first bottom mirror |
| 15 | first interior mirror |
| 16 | first upper interior wall |
| 17 | leg |
| 18 | slot |
| 19 | screw |
| 20 | first playing card surface |
| 21 | playing card |
| 22 | angled wall |
| 23 | first bottom wall |
| 24 | first rear wall |
| 25 | lower interior wall |
| 30 | first viewing window |
| 40 | mirror system embodiment |
| 41 | dimension "W1" |
| 42 | first indicia |
| 43 | first rear wall |
| 44 | second viewing window |

-continued

| DESCRIPTIVE KEY |
|---|
| 45 second side wall |
| 46 second playing card surface |
| 47 second rear wall |
| 48 second top wall |
| 49 second upper interior wall |
| 50 second interior mirror |
| 51 second bottom mirror |
| 52 second bottom wall |
| 60 four card embodiment |
| 61 dimension "W2" |
| 62 second indicia |
| 63 second rear wall |
| 66 third playing card surface |
| 67 third rear wall |
| 68 third top wall |

DETAILED DESCRIPTION OF THE PREFERRED EMBODIMENT

Figure 7A:
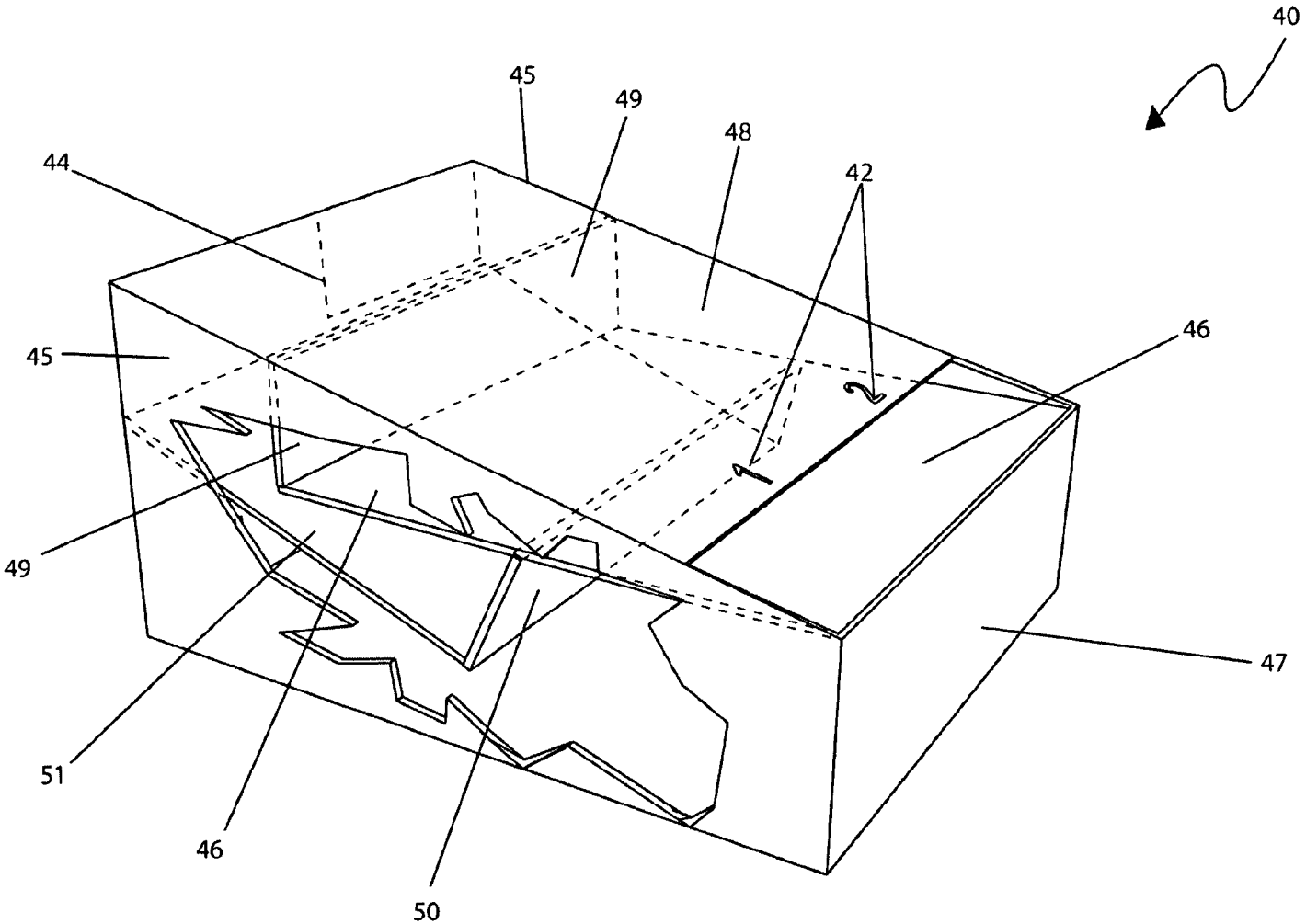
FIG. 7*a* is a side perspective view of the device for holding and viewing playing cards 10 depicting an alternate mirror system 40, according to an alternate embodiment of the present invention.
Figure 7B:
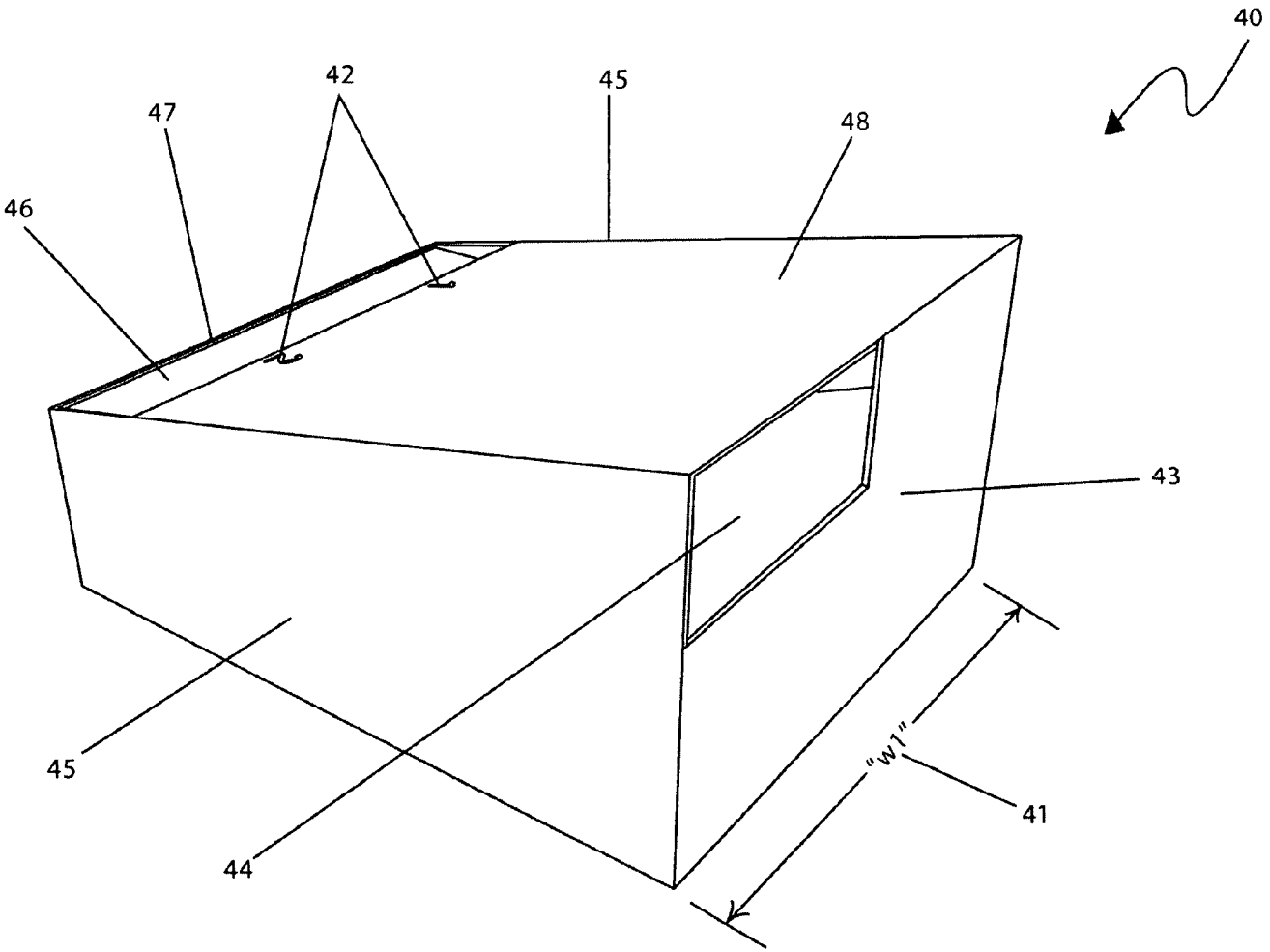
FIG. 7*b* is a rear perspective view of the device for holding and viewing playing cards 10 depicting an alternate mirror system 40, according to an alternate embodiment of the present invention.
Figure 7C:
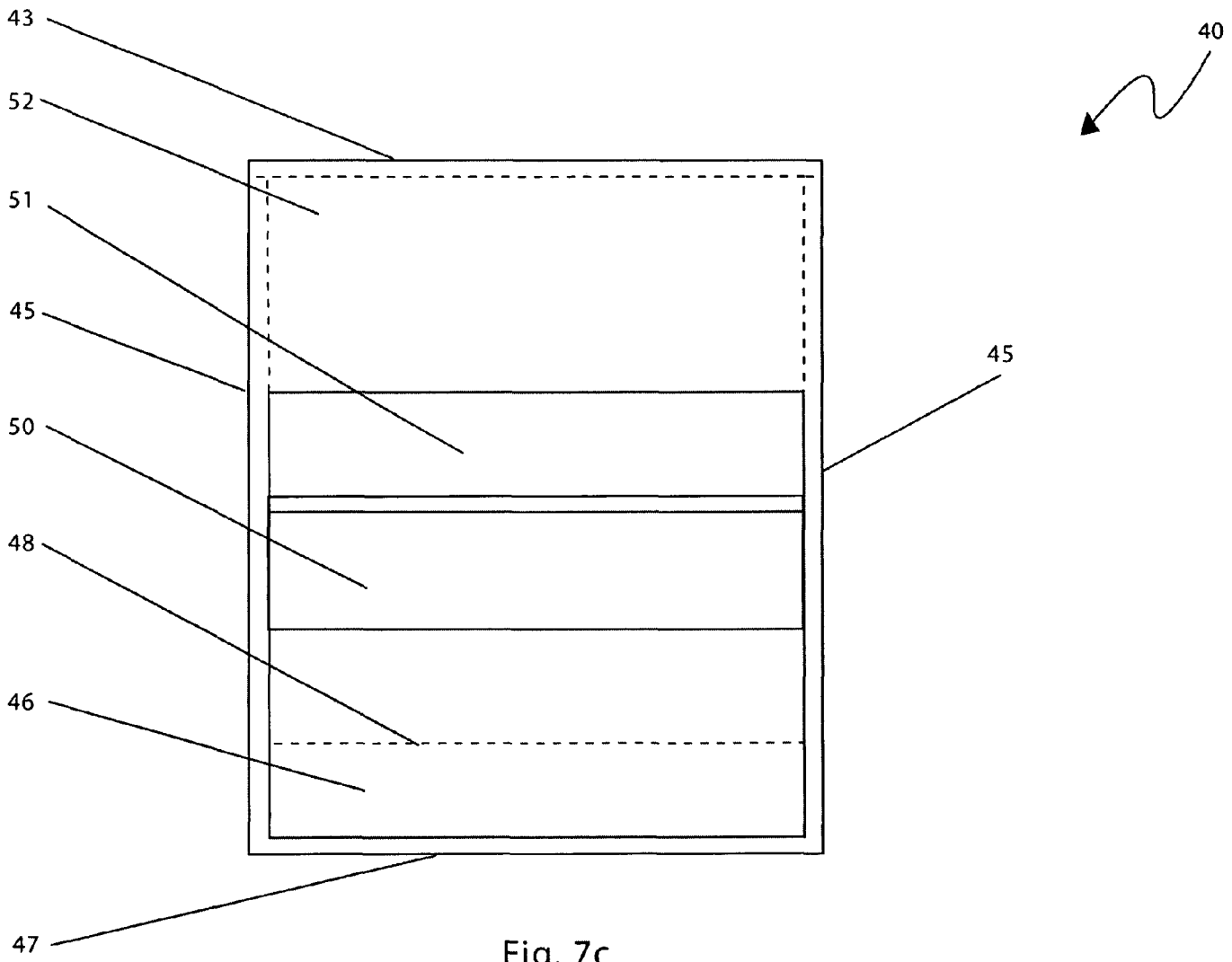
FIG. 7*c* is a bottom view of the device for holding and viewing playing cards 10 depicting an alternate mirror system 40, according to an alternate embodiment of the present invention.
Figure 7D:
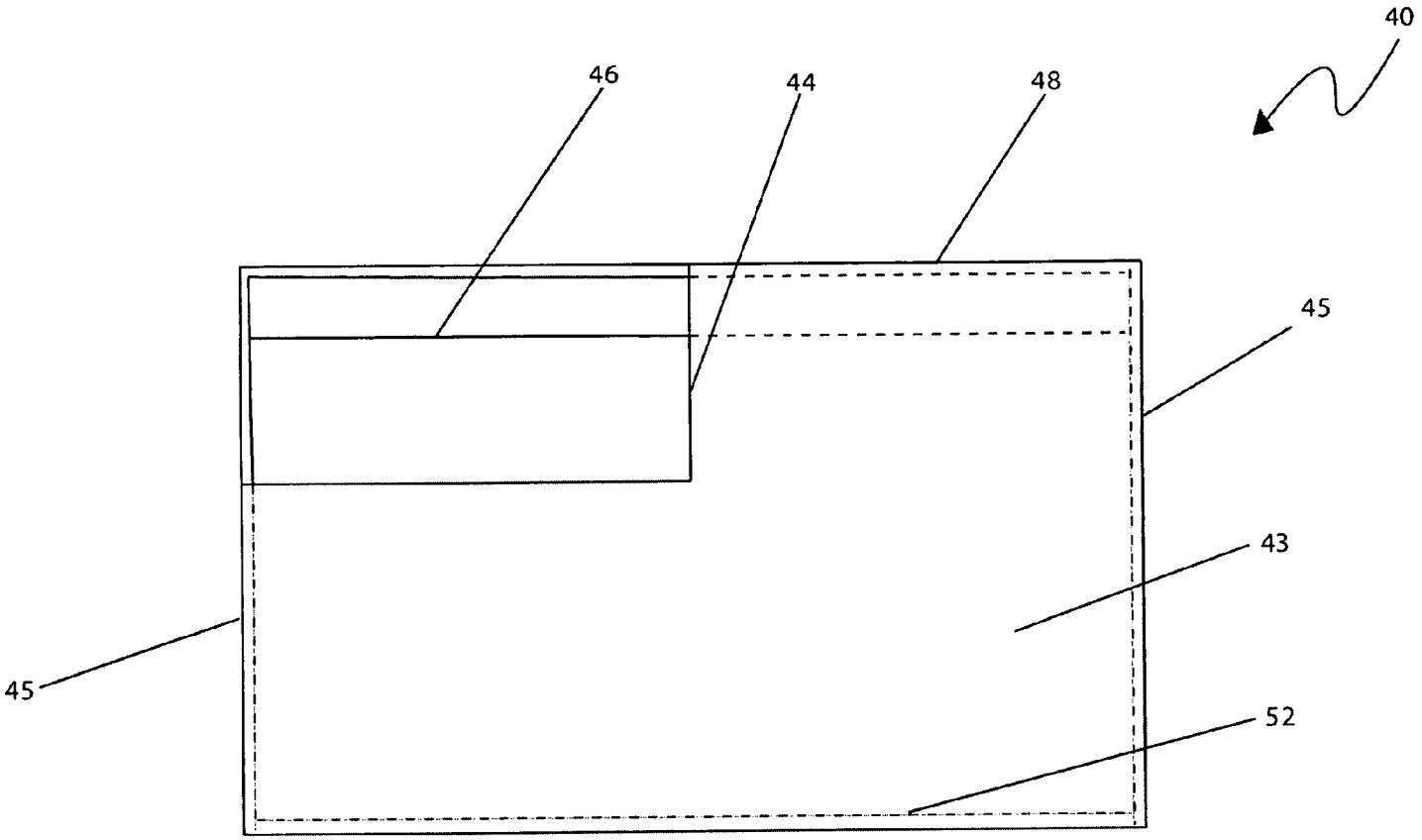
FIG. 7*d* is a rear view of the device for holding and viewing playing cards 10 depicting an alternate mirror system 40, according to an alternate embodiment of the present invention; and, FIG. 8 is a rear perspective view of a four card embodiment 60 of the device 10, according to an alternate embodiment of the present invention.
Figure 8:
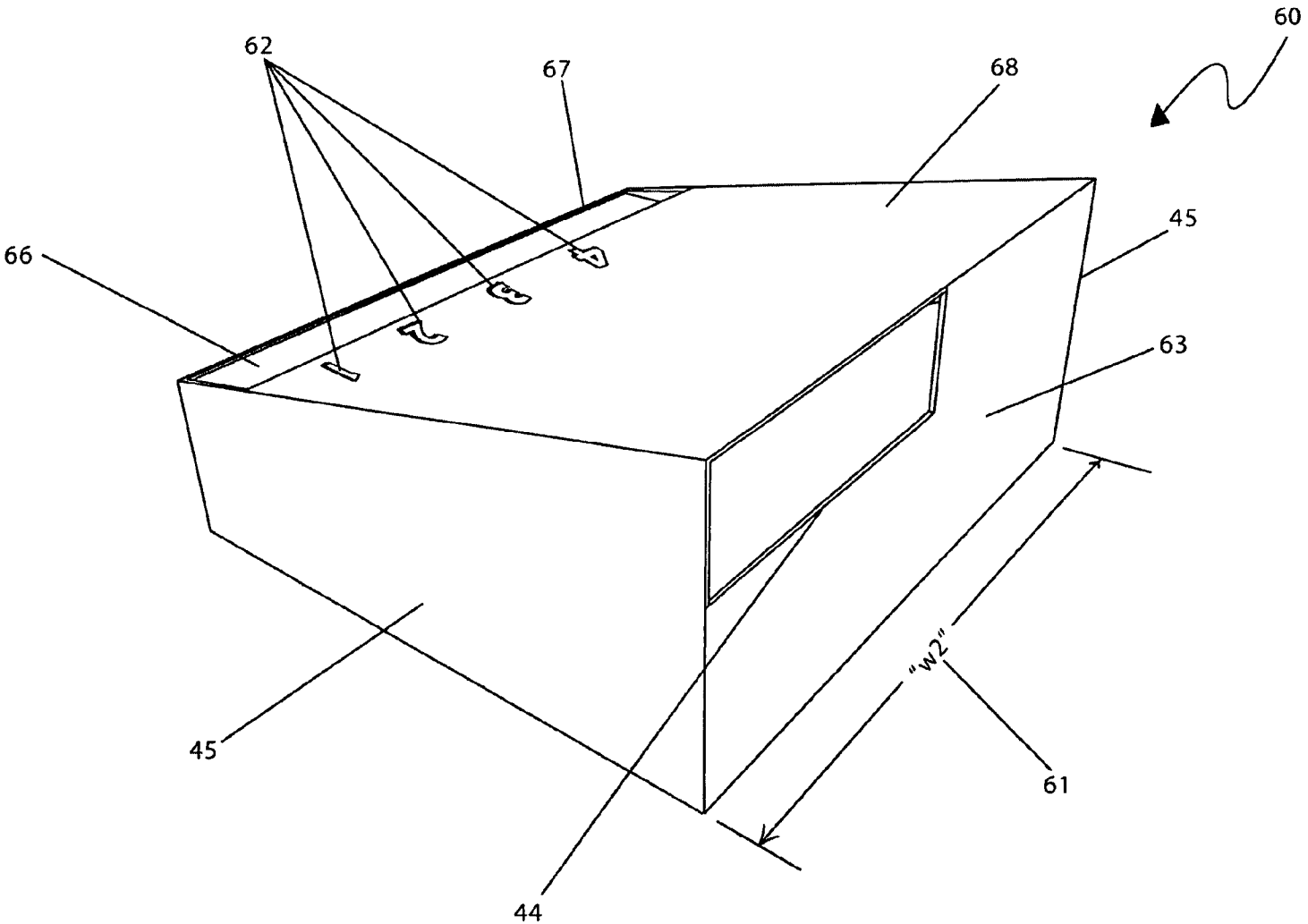

The best mode for carrying out the invention is presented in terms of its preferred embodiment, herein depicted within FIGS. 1 through 6 and in alternate embodiments as depicted in FIGS. 7*a* through 8. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Referring now to FIGS. 1 through 6, various perspective and elevation views of the present invention, a device for holding and viewing playing cards 10 (hereafter referred to as the "device") generally comprising a shielded structure utilizing integral mirror assemblies and adjustable supports, are herein disclosed. The shielded structure comprises a wooden or plastic construction utilizing common adhesive or fastening means such as glue, bonding, or basic mechanical hardware. The preferred embodiment of the device 10 accommodates two (2) playing cards 21, and may be expanded in an alternate embodiment for additional playing cards 21 most commonly associated with popular games.

Two (2) first side walls 11 of a semi-trapezoidal shape are oriented opposite from each other and define an interior space within. Attached to an intermediary vertical location on both the first side walls 11, and extending from the leading edge of said first side walls 11 in a downwardly slanting direction to the bottom edge of the first side walls 11 at a location short of the corners, is a rectangular plate defining an angled wall 22. A second rectangular plate defines a first bottom wall 23 extending rearward from the connection point of the angled wall 22 to each first side wall 11 to the bottom rear corners of each first side wall 11. A first rear wall 24, shaped as another rectangular plate, extends upward from the bottom rear corners of the first side walls 11 perpendicular to the first bottom wall 23 to the lower vertical points of the first side walls' 11 trapezoidal shape. A fourth rectangular plate, defining a first playing card surface 20, spans the width defined by the first side walls 11 and a length approximately half of a conventional playing card 21 projecting towards the front of the device 10. Extending upward from the lower connection point of the first bottom wall 23 and first side walls 11 to the first playing card surface 20 is a lower interior wall 25, opposing and equal in dimension to the first rear wall 24, and also constructed as a rectangular plate. Yet another rectangular plate defines a first top wall 12, which extends from the front upper corners of the first side walls 11 to the upper vertical point of the first side walls' 11 trapezoidal shape. A seventh rectangular plate finally defines a first upper interior wall 16, which extends downward from the connection point of the first side walls 11 and first top wall 12 to an intermediary point along the interior surfaces of the first side walls 11, roughly equal to the height of the first playing card surface 20. The area defined therein by the first top wall 12, both opposing first side walls 11, and the angled wall 22 is known as the first viewing window 30, permitting the unhindered viewing of the reflected image of the playing cards 21 onto the first interior mirror 15.

Two mirrors are placed within the device 10 for projecting a playing card 21 to the user viewing through the front of the device 10. A rectangular first interior mirror, 15 shaped to match the width of the interior space defined by the first side walls 11, is affixed to the lower interior wall 25, via adhesive or other similar adhering means, with a height not exceeding that of the lower interior wall 25. A second rectangular first bottom mirror 14 is affixed on the angled wall 22 via an adhesive or other adhering means. The location of the angled wall 22 and hence, the first bottom mirror 14, is dependent on the ability to easily view the projected image of the playing cards 21 placed on and extending past the playing card surface 21.

Figure 1:
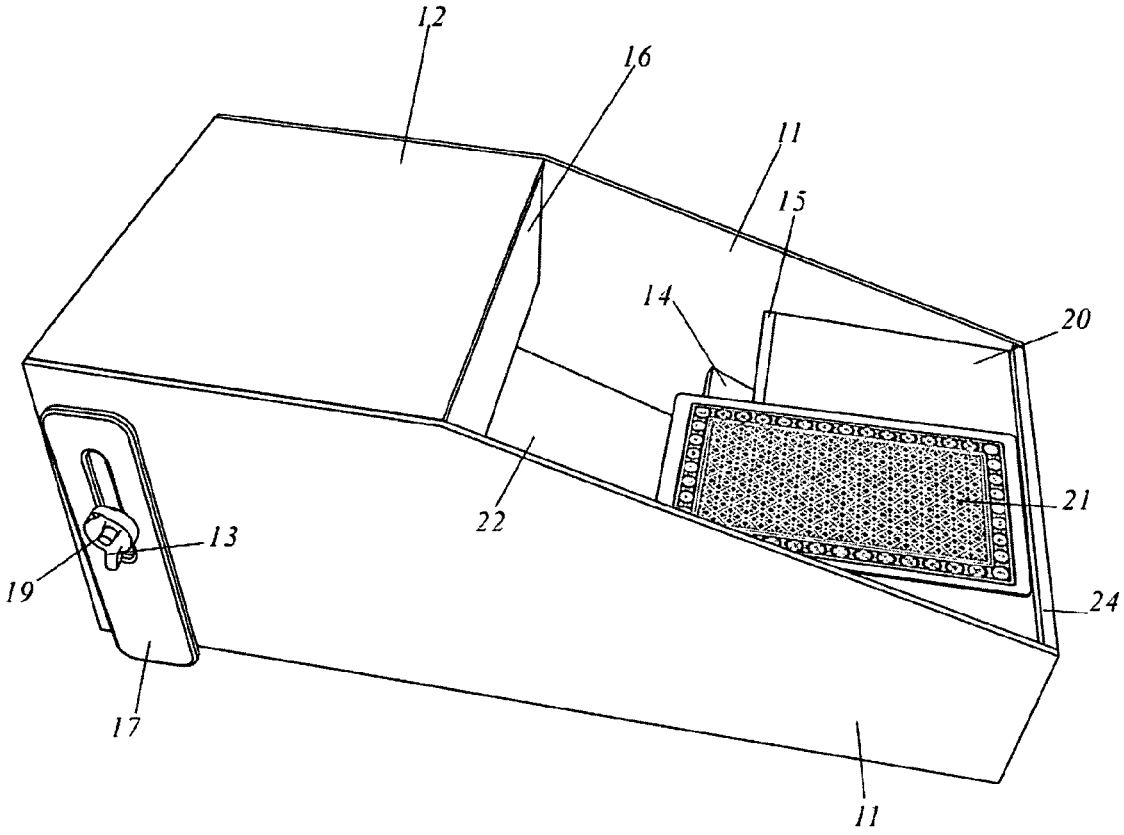
FIG. 1 is a side perspective view of a device for holding and viewing playing cards 10, according to a preferred embodiment of the present invention.
Figure 2:
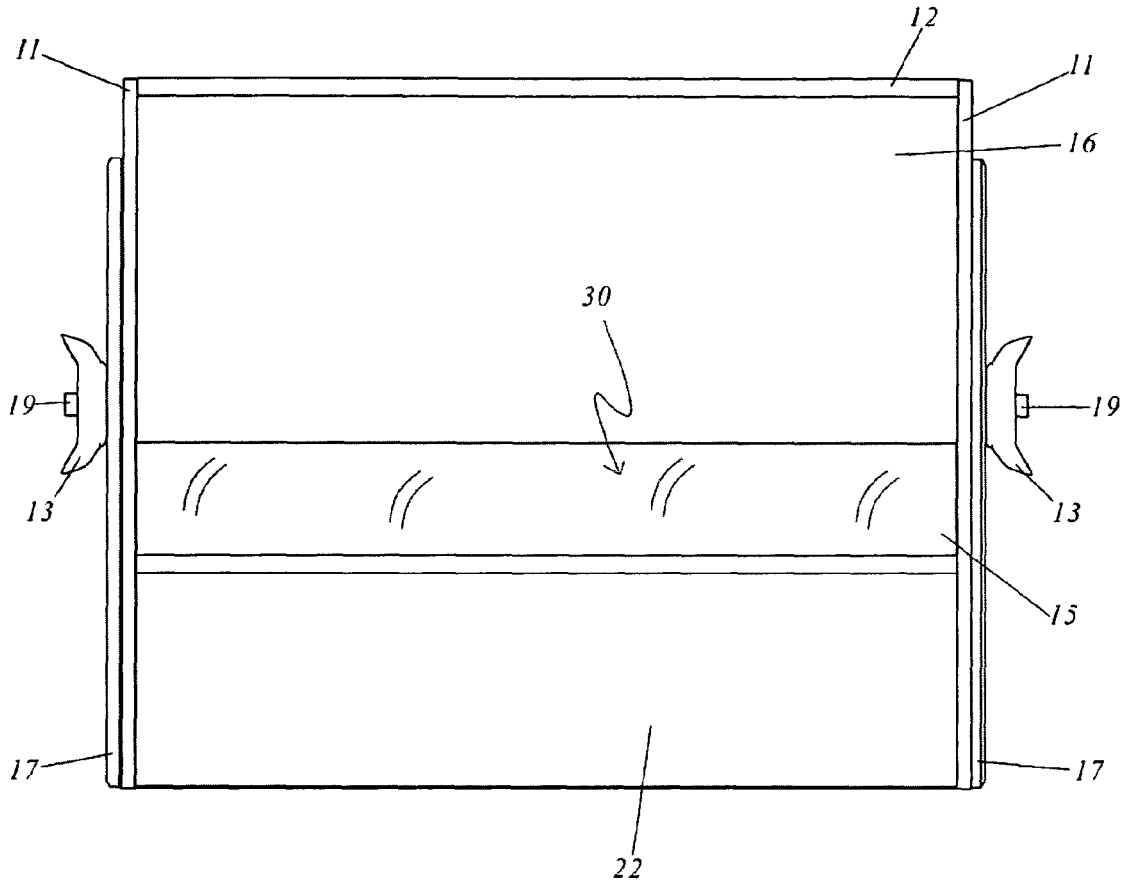
FIG. 2 is a front elevation view of the device for holding and viewing playing cards 10, according to a preferred embodiment of the present invention.
Figure 3:
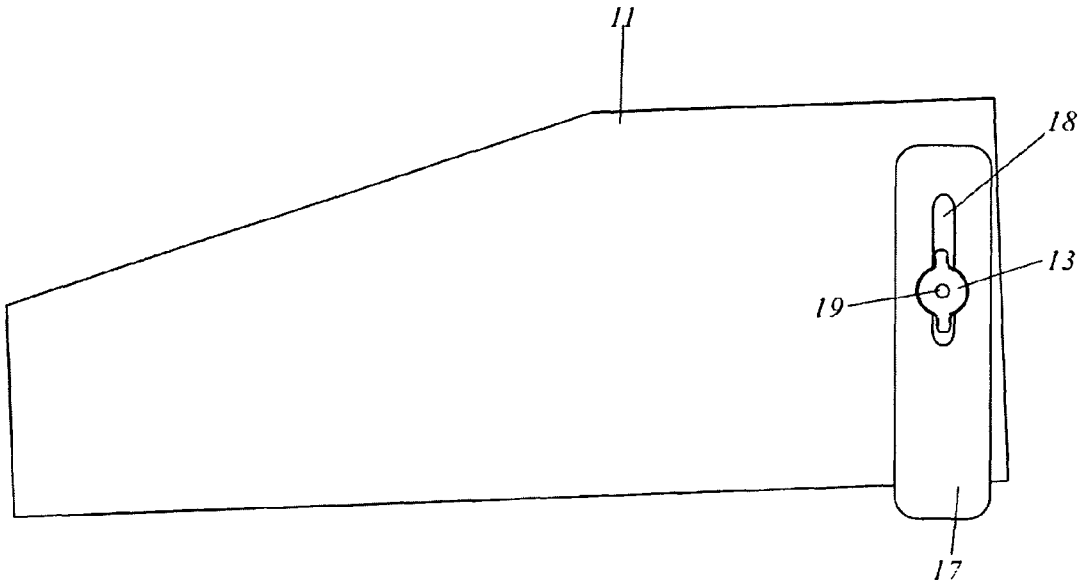
FIG. 3 is a side view of the device for holding and viewing playing cards 10, according to a preferred embodiment of the present invention.
Figure 4:
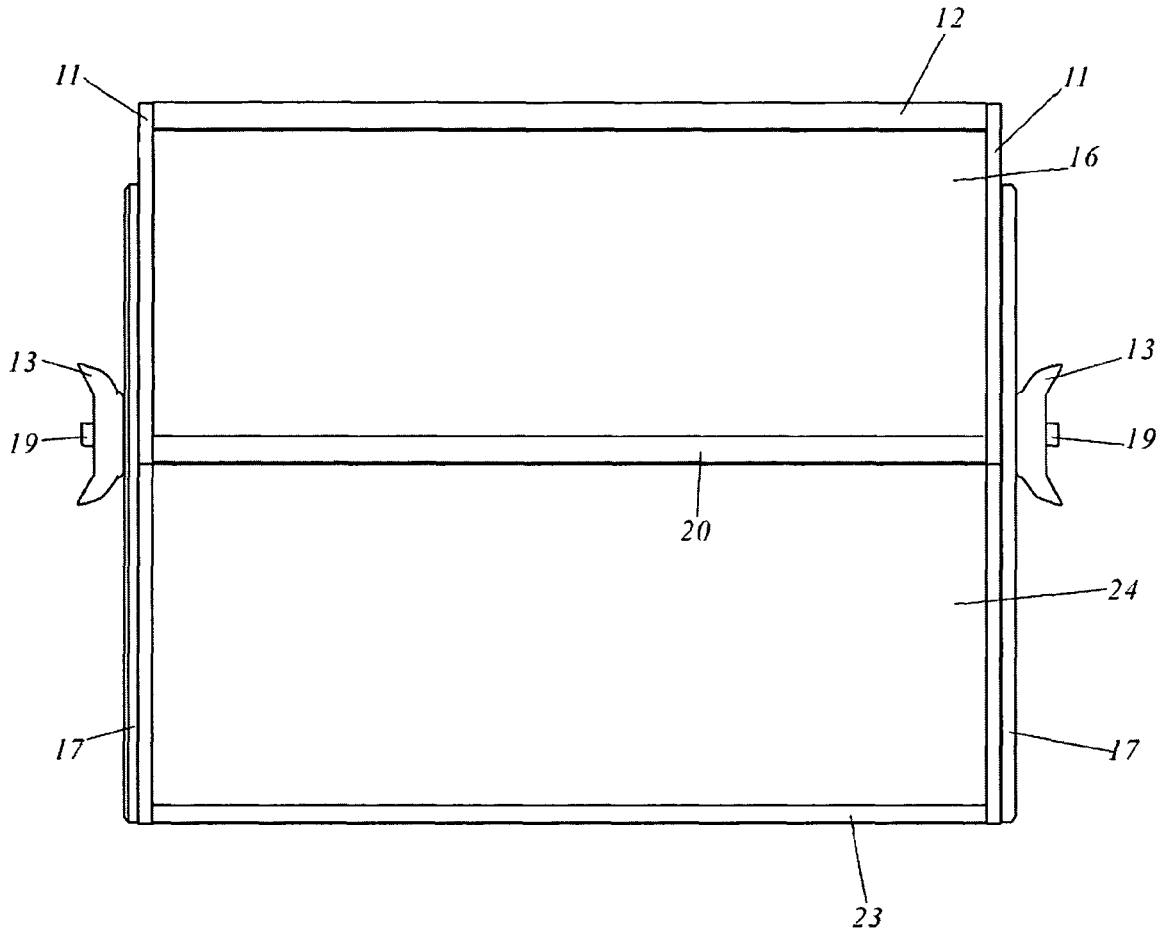
FIG. 4 is a rear view of the device for holding and viewing playing cards 10, according to a preferred embodiment of the present invention.
Figure 5:
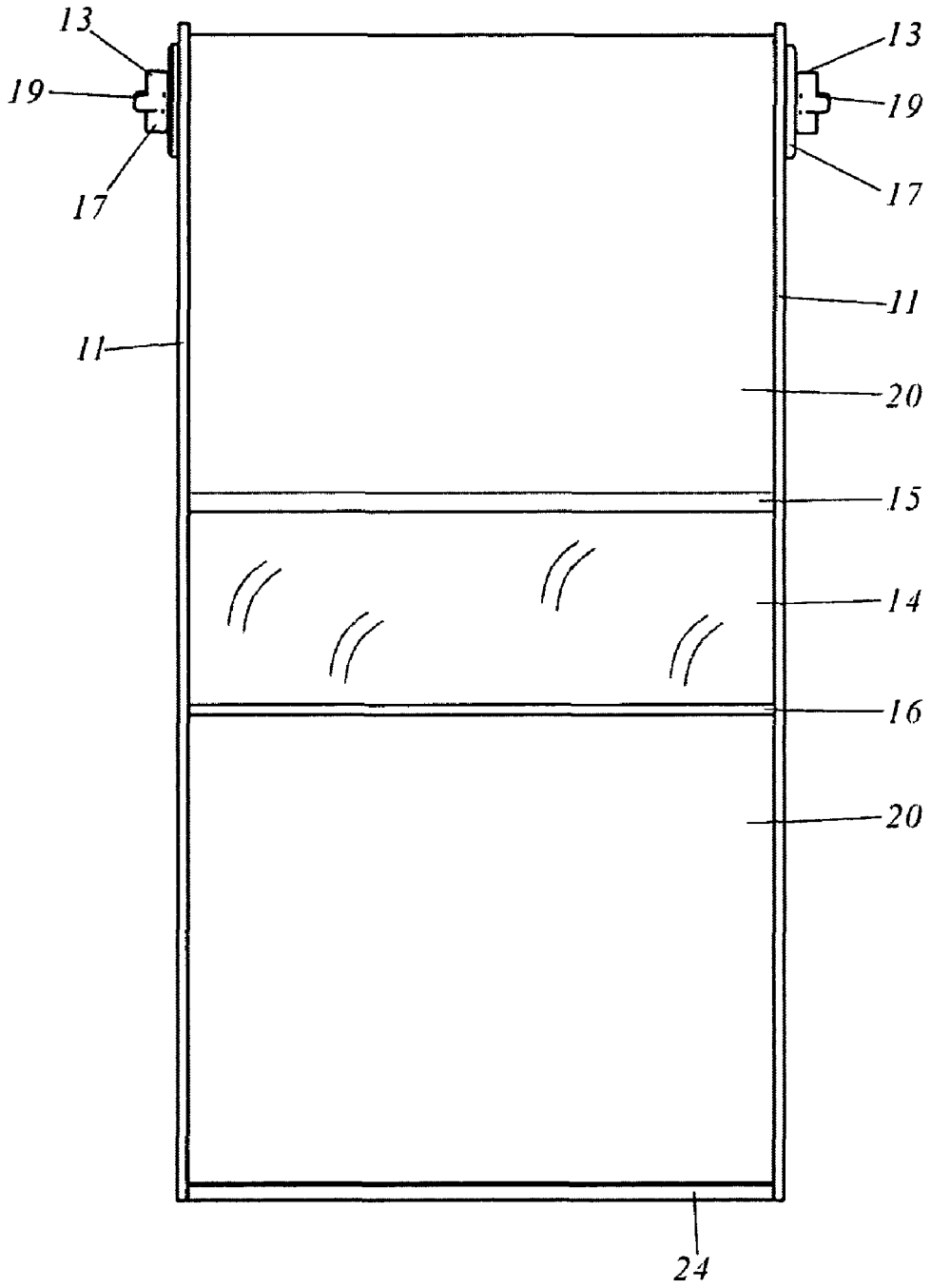
FIG. 5 is a top view of the device for holding and viewing playing cards 10, according to a preferred embodiment of the present invention.
Figure 6:
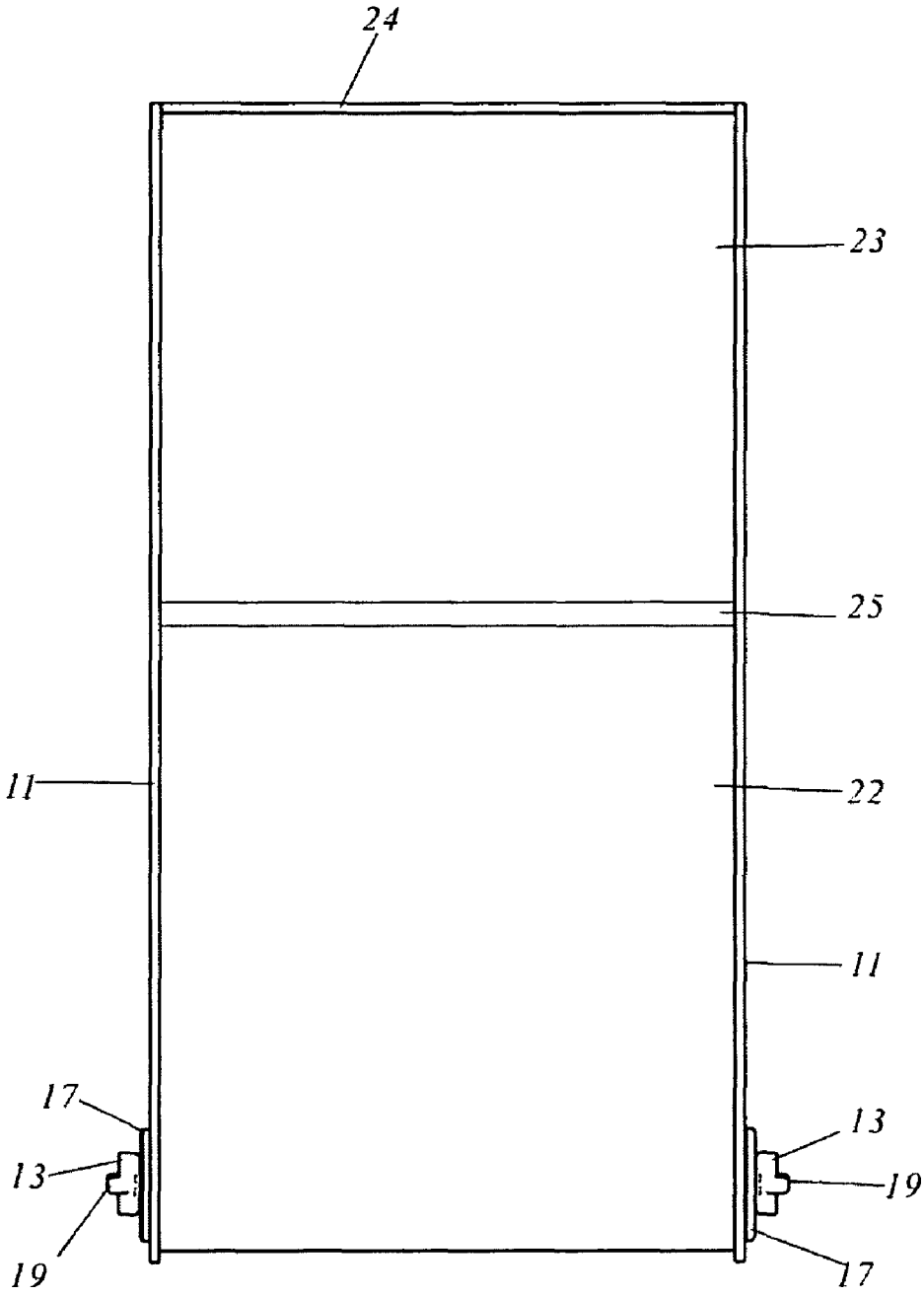
FIG. 6 is a bottom view of the device for holding and viewing playing cards 10, according to a preferred embodiment of the present invention.

Referring now to FIG. 1, which depicts the device 10 in a side perspective view, one (1) of an identical pair of adjustable legs 17 is easily shown. Each leg 17 is a rectangular-shaped plate with or without rounded edges and a long edge typically not exceeding that of the height of the first side walls 11 at their highest point, and is affixed to each first side wall 11 at the leading front edge. Each leg 17 has an oval-shaped slot 18 formed in its interior with a diameter matching that of a conventional screw 19 or similar piece of hardware. The screw 19 is fed through a pre-drilled hole through the first side wall 11 and the slot 18 of the leg 17. A wing nut 13 or other similar device secures the leg 17 by threaded attachment to the screw 19.

The preferred embodiment of the present invention is designed to be used by a person with no special skills or training being necessary, but most typically is intended for the handicapped or those unfortunate enough to have limited or no use of their hands. After procurement of the device 10, an apparatus for holding and viewing playing cards 10, the user sets the first bottom wall 23 of the device 10 in front of them on a table or other horizontal surface such that the device 10 is positioned to be easily viewed by the player, with the front of the device defined as the portion where the mirrors 14, 15 are most easily seen and the legs 17 are in the front. If necessary, the legs 17 of the device 10 may be adjusted to allow the user to see the interior by loosening the wing nut 13, adjusting the legs 17 upward or downward with the screw 19 in the adjustment slot 18, and, re-tightening the wing nut 13 on the screw 19. This enables the viewing angle through the first viewing window 30 to change depending on the desires of the player.

Once the desired height of the device 10 has been set, the first bottom mirror 14 must be placed on the angled wall 22 near its lowest point, so that it abuts the first interior mirror 15, if previously installed. If the first interior mirror 15 is not previously installed, it must be placed in a position such that it is laid flat against the lower interior wall 25. Then, when the user is ready to receive the playing cards 21, the dealer or player's assistant places the playing cards 21 face down onto the first playing card surface 20, ensuring that an ample portion of each playing card 21 extends over the first surface 20. The portion of the playing card 21 that extends over the first surface 20 has its image then projected onto the first bottom mirror 14. If one views this image, the common property of a reversed image from a mirror is readily observed. However, with the proper angle of the angled wall 22, and henceforth the first bottom mirror 14, the first bottom mirror 14 projects the reversed image of the playing cards 21 onto the first interior mirror 15, which reverses it again, resulting in a "true" representation of the playing cards 21. Therefore, the user merely has to view the first interior mirror 15 to see the image of the card(s) 21 placed on the first playing card surface 20. The first upper interior wall 16, lower interior wall 25, first top wall 12, and first side walls 11 act as a shield from adjacent players surreptitiously viewing an opponent's playing cards 21.

Referring now to FIGS. 7*a* through 7*d*, various perspective and elevation views of a mirror system embodiment 40 of the device 10, according to an alternate embodiment of the present invention, are disclosed. The alternate mirror embodiment 40 comprises a pair of second side walls 45, a second bottom wall 52, a second rear wall 47, a second top wall 48, a second upper interior wall 49, a second playing card surface 46, a first rear wall 43, a second interior mirror 50, a second bottom mirror 51, and a second viewing window 44.

The alternate mirror embodiment 40 is envisioned being made using similar materials and assembly methods as the preferred embodiment 10. The alternate mirror embodiment 40 accommodates two (2) playing cards 21.

The two (2) second side walls 45 are of a trapezoidal shape and are oriented opposite from each other as defined by dimension "W1" 41 being approximately four (4) inches, thereby providing an interior space within. A rectangular plate defines a second bottom wall 52 extending forward in a planar manner therefrom connection points at front bottom corners of the second side walls 45 having a length of approximately one-third that of the second side walls 45. The second rear wall 47 is shaped as another rectangular plate extending upward from the bottom rear corners of the second side walls 45; along a vertical front edge; to top rear corners of said second side walls 45. Yet another rectangular plate defines a second top wall 48 which extends rearward therefrom the front upper corners of the second side walls 45 along a top edge of said second side walls 45 terminating approximately three-quarters (¾) inches from the second rear wall 47. The second top wall 48 further comprises particular first numeric indicia 42 representing loading positions for two (2) playing cards 21. The second playing card surface 46 comprises a rectangular transparent plate being attached along a top edge of said second rear wall 47 projecting perpendicular to the second rear wall 47 along a horizontal plane toward the front of the device 40 and spanning a width defined by the second side walls 45 being approximately half the size of a conventional playing card 21 in length. A second upper interior wall 49 comprising a transparent rectangular shape is attached along a front edge of said second playing card surface 46 and extends vertically upward to a connection point along a bottom surface of the second top wall 48 therebetween, and spanning the second side walls 45. The end of the second side walls 45 and the top edge of the second rear wall 47 form a rectangular aperture in which playing cards 21 may be inserted thereupon the second playing card surface 46. Extending upward from a lower front connection point of the second bottom wall 52 and second side walls 45 to a top rear corner of the second side walls 45 is a first rear wall 43 also constructed as a rectangular plate. The first rear wall 43 comprises a second viewing window 44 being approximately one (1) inch high and two (2) inches wide located at a top left corner of said first rear wall 43 permitting the unhindered viewing of the reflected image of the playing cards 21 onto a second bottom mirror 51 and a second interior mirror 50.

The second interior mirror 50 and the second bottom mirror 51 are placed within the device 40 for projecting an image of a playing card 21 to the user viewing through the second viewing window 44. The second interior mirror 50 is shaped to match the width of the interior space defined by the second side walls 45 being affixed to said second side walls 45 orientated at an angle approximately sixty degrees (60°) from a horizontal plane and affixed at an intermediate location along a bottom surface of the second playing card surface 46. The second rectangular bottom mirror 51 is affixed thereto a bottom edge of the second interior mirror 50 projecting in a perpendicular direction therefrom said second interior mirror 50 toward a front portion of the device 40. The locations of the second bottom mirror 51 and second interior mirror 50 are dependent on the ability to easily view the projected image of the playing cards 21 placed on the second playing card surface 46.

Referring now to FIG. 8, a rear perspective view of a four card embodiment 60 of the device 10, according to an alternate embodiment of the present invention, is disclosed. The alternate four card embodiment 60 comprises similar materials and assembly methods as the preferred embodiment 10.

The alternate four card embodiment 60 comprises a second indicia 62, a second rear wall 63, a third playing card surface 66, a third rear wall 67, and a third top wall 68.

The alternate four card embodiment 60 shown here is envisioned to provide similar functionality as, and employ similar construction methods as the alternate mirror system embodiment 40 previously described. However, the distance between the second side walls 45 comprises an increased width to facilitate four (4) playing cards 21 as defined by dimension "W2" 62 and being approximately six (6) inches in width. The second rear wall 63, third playing card surface 66, third rear wall 67, and the third top wall 68 also comprise increased widths accordingly. The third top wall 68 further comprises particular numeric indicia 61 indicating anticipated positions for four (4) playing cards 21 in a similar manner as the aforementioned alternate mirror system embodiment 40. Additional internal components (not shown) also spanning the second side walls 45 are envisioned to comprise increased widths as well, in an expected manner.

It is envisioned that other styles and configurations of the present invention can be easily incorporated into the teachings of the present invention, and only one particular configuration shall be shown and described for purposes of clarity and disclosure and not by way of limitation of scope.

The embodiments depicted herein are designed to be used by a person with no special skills or training, but are most typically intended for the handicapped or those unfortunate having limited use or no use of their hands. After initial purchase or acquisition of the device 10, it would be installed as indicated in FIG. 1 and alternately as depicted in FIGS. 7*a* and 8.

The method of utilizing the device 10 may be achieved by performing the following steps: After procurement of the device 10, the user sets the device 10 in front of them on a table or other horizontal surface such that the device 10 is positioned to be easily viewed by the player, with the front of the device defined as the portion where the mirrors 14, 15 are most easily seen and the legs 17 are in the front. If necessary, the legs 17 of the device 10 may be adjusted to allow the user to see the interior by loosening the wing nut 13, adjusting the legs 17 upward or downward with the screw 19 in the adjustment slot 18, and re-tightening of the wing nut 13 on the screw 19.

Once the desired height of the device 10 has been set, the first bottom mirror 14 must be placed on the angled wall 22 so that it abuts the first interior mirror 15. Then, when the user is ready to receive the playing cards 21, the dealer or player's assistant places the playing cards 21 face down onto the first playing card surface 20, ensuring that an ample portion of each playing card 21 extends over the first surface 20. The portion of the playing card 21 that extends over the first surface 20 has its image then projected onto the first bottom mirror 14. If one views this image, the common property of a reversed image from a mirror is readily observed. However, with the proper angle of the angled wall 22, and henceforth the first bottom mirror 14, the first bottom mirror 14 projects the reversed image of the playing cards 21 onto the first interior mirror 15, which reverses it again, resulting in a "true" representation of the playing cards 21. Therefore, the user merely has to view the first interior mirror 15 to see the image of the card(s) 21 placed on the first playing card surface 20. The first upper interior wall 16, lower interior wall 25, first top wall 12, and first side walls 11 act as a shield from adjacent players surreptitiously viewing a user's playing cards 21.

The method of utilizing the alternate mirror system embodiment 40 and the alternate four card embodiment 60 of the invention 10 may be achieved by performing the steps described above with the addition of the following: loading and positioning two (2) or four (4) playing cards 21 into the mirror system embodiment 40 and the four card embodiment 60, respectively; aligning said cards 21 with the indicia 42, 62 located upon the top walls 48, 68, respectively; and, benefiting from shielding elements of the alternate embodiments of the invention 40, 60 while viewing one's playing cards 21.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A device for holding and viewing one playing card comprising:

a shielded structure, further comprising:

a plurality of first side walls;

a first rectangular plate defining an angled wall connected to said first side walls;

a second rectangular plate defining a first bottom wall extending rearward from a connection point of said angled wall to each of said first side walls and further to the bottom rear corners of each first side wall;

a third rectangular plate defining a first rear wall connected to said first side walls;

a fourth rectangular plate defining a first playing card surface spanning an entire width between said first side walls;

a lower interior wall extending upward from a lower connection point of said first bottom wall and said first side walls to said first playing card surface;

a fifth rectangular plate defining a first top wall;

a seventh rectangular plate defining a first upper interior wall extending downwardly from a connection point of said first side walls and said first top wall to an intermediary point along interior surfaces of said first side walls; and, a first viewing window defined by said first top wall and said first side walls and said angled wall respectively;

a plurality of mirrors connected to said shielded structure, further comprising:

a rectangular first interior mirror shaped to match a width of an interior space defined between said first side walls, said first interior mirror being affixed to said lower interior wall; and, a second rectangular first bottom mirror affixed to said angled wall; and, a plurality of adjustable supports connected to said shielded structure in such a manner that said shielded structure is adapted between raised and lowered positions;

wherein said plurality of mirrors cooperate to reflect at least one reversed image of the playing card and at least one true image of the playing card so that a user can readily determined a value of the playing card.

2. A device for holding and viewing two playing cards comprising:

a pair of side walls spaced apart from each other;

a first rectangular plate defining a bottom wall extending forward in a planar manner from connection points at front bottom corners of said side walls and having a length of approximately one-third that of said side walls;

a second rectangular plate defining a rear wall and extending upward from bottom rear corners of said side walls along a vertical front edge of said bottom wall and to top rear corners of said side walls;

a third rectangular plate defining a top wall extending rearwardly from front upper corners of said side walls and along a top edge of said side walls;

a transparent fourth rectangular plate defining a playing card surface attached along a top edge of said rear wall and projecting perpendicular to said rear wall, said playing card surface further extending along a horizontal plane toward a front of said device and spanning a width defined between said side walls;

a transparent fifth rectangular plate defining an upper interior wall attached along a front edge of said second playing card surface and extending vertically upward to a connection point along a bottom surface of said top wall, said upper interior wall spanning between said side walls;

a sixth rectangular plate defining a rear wall extending upward from a lower front connection point of said bottom wall and said side walls to a top rear corner of said side walls;

interior and bottom mirrors for projecting an image of said two playing cards to a user viewing through a viewing window;

wherein said interior mirror is shaped to match a width of an interior space defined between said side walls;

wherein said interior mirror is affixed to said side walls and is orientated at an angle approximately sixty degrees from a horizontal plane and is further affixed at an intermediate location defined along a bottom surface of said playing card surface;

wherein said bottom mirror is affixed to a bottom edge of said interior mirror and projects in a perpendicular direction from said interior mirror toward a front portion of said device;

wherein said rear wall defines said viewing window located at a top left corner of said rear wall for permitting unhindered viewing of a reflected image of said two playing cards;

wherein an end of said side walls and said top edge of said rear wall form a rectangular aperture in which said two playing cards are inserted on said playing card surface.

3. The device of claim 2, wherein said top wall further comprises indicia representing loading positions for a plurality of playing cards.

4. A method for allowing a player to discretely viewing a value of a playing card while said player does not touch said playing card, said method comprising the steps of:

a. setting a shielded structure in front of said player and on a surface such that said shielded structure is easily viewed by said player while an interior of said shielded structure is invisible from surrounding players, wherein said shielded structure further comprises:

a plurality of first side walls;

a first rectangular plate defining an angled wall connected to said first side walls;

a second rectangular plate defining a first bottom wall extending rearward from a connection point of said angled wall to each of said first side walls and further to the bottom rear corners of each first side wall;

a third rectangular plate defining a first rear wall connected to said first side walls;

a fourth rectangular plate defining a first playing card surface spanning an entire width between said first side walls;

a lower interior wall extending upward from a lower connection point of said first bottom wall and said first side walls to said first playing card surface;

a fifth rectangular plate defining a first top wall;

a seventh rectangular plate defining a first upper interior wall extending downwardly from a connection point of said first side walls and said first top wall to an intermediary point along interior surfaces of said first side walls; and, a first viewing window defined by said first top wall and said first side walls and said angled wall respectively;

b. placing a bottom mirror on said angled wall so that said bottom mirror abuts an interior mirror shaped to match a width of an interior space defined between said first side walls, said interior mirror affixed thereto said lower interior wall;

c. placing said playing card face down onto said first playing card surface by ensuring that an ample portion of said playing card extends over said first playing card surface;

d. projecting a reversed image of said ample portion of said playing card onto said bottom mirror;

e. adjusting a position of said angled wall with respect to said bottom mirror such that said bottom mirror projects said reversed image of said playing card onto said interior mirror;

f. said bottom mirror reversing said reversed image to thereby provide a true image of said playing card; and, g. said player viewing said interior mirror to see said true image of said playing card.

5. The method of claim 4, further comprising the steps of:

h. loading and positioning at least one additional playing card on said playing card surface; and, i. aligning said additional playing card with indicia located upon said top walls of said shielded structure.

* * * * *